US007168688B2

(12) United States Patent
Davenport

(10) Patent No.: US 7,168,688 B2
(45) Date of Patent: Jan. 30, 2007

(54) PRIVACY FENCE

(75) Inventor: David R. Davenport, Burleson, TX (US)

(73) Assignee: The Burly Corporation, Burleson, TX (US)

( * ) Notice: Subject to any disclaimer, the term of this patent is extended or adjusted under 35 U.S.C. 154(b) by 0 days.

(21) Appl. No.: 11/126,532

(22) Filed: May 11, 2005

(65) Prior Publication Data

US 2006/0255324 A1 Nov. 16, 2006

(51) Int. Cl.
*E04H 17/16* (2006.01)

(52) U.S. Cl. ..... 256/24; 256/67; 256/65.03; 256/65.08

(58) Field of Classification Search ..... 256/19, 256/21, 24, 59, 60, 67, 65.02, 65.03, 65.08, 256/65.16; 472/85, 86, 87; 119/422, 502, 119/704, 705

See application file for complete search history.

(56) References Cited

U.S. PATENT DOCUMENTS 2,740,613 A 4/1956 Berliner
3,395,489 A * 8/1968 Banse ..... 49/381
3,942,763 A * 3/1976 Helterbrand et al. ..... 256/22
4,149,700 A * 4/1979 Stafford ..... 256/24
4,193,584 A 3/1980 Wieser
4,225,120 A * 9/1980 McLaughlin ..... 256/24
4,300,313 A * 11/1981 Steinke ..... 49/463
4,306,631 A * 12/1981 Reusser ..... 181/210
4,364,546 A 12/1982 Lyman et al.
4,623,128 A * 11/1986 Dutch et al. ..... 256/65.08
5,695,174 A 12/1997 Tsai
5,725,201 A 3/1998 Parth
5,904,343 A 5/1999 Parth
5,938,184 A * 8/1999 DeSouza ..... 256/19
6,029,954 A * 2/2000 Murdaca ..... 256/59
6,260,828 B1 7/2001 English
2004/0046162 A1* 3/2004 Zhu ..... 256/65.03

* cited by examiner

*Primary Examiner*—Daniel P. Stodola
*Assistant Examiner*—Daniel J. Mills
(74) *Attorney, Agent, or Firm*—Bracewell & Giuliani LLP

(57) ABSTRACT

A fence section has upper and lower brackets that mount to one side of a post. Each bracket has a pair of rail mounting plates extending from opposite side edges of a post mounting plate. Upper and lower rails extend between the upper and lower mounting brackets. Each of the rails has a pair of sidewalls and an offset skirt extending from a base section, defining an elongated slot. The rails have ends that slide over and receive the rail mounting plates of the brackets. A panel has upper and lower edges that fit in the slot of the upper and lower rails.

16 Claims, 2 Drawing Sheets

PRIVACY FENCE

FIELD OF THE INVENTION

This invention relates in general to fences, and in particular to a metal privacy fence.

DESCRIPTION OF THE PRIOR ART

Privacy fences that enclose backyards of residential homes are very common. Fences of this nature provide privacy in a backyard as well as keeping small children and dogs within the backyard.

The most common type of privacy fence comprises a wooden fence made up of posts, upper and lower rails, and boards nailed to the rails. In some case, the posts may be metal or brick. Regardless of the posts, the boards of the fence are of wood and deteriorate with time. Fences of this nature sag, and the boards come loose. Eventually, a wooden fence must be replaced, and it is often unsightly for years before the replacement occurs.

Metal fences have been used for backyards, but primarily they have been chain-link fences. Though long-lasting, they do not provide privacy. In some cases, plastic or metal strips are threaded through such fences for privacy.

Metal panel fences are less common, and are usually custom fabricated for industrial use. Some may require welding of the rails to the posts. Some may require painting at frequent intervals to prevent rust.

SUMMARY OF THE INVENTION

In this invention, a privacy fence constructed of metal, preferably aluminum, is provided. The posts for the fence have upper and lower brackets. Each of the brackets has a post mounting plate secured to one side of the post and at least one rail mounting plate that extends forward from the post mounting plate. Upper and lower rails are connected between the posts. Each rail has an end that is secured to the rail mounting plate of one of the brackets.

Each rail has a pair of sidewalls extending vertically from a horizontal base section. The sidewalls are parallel to each other and perpendicular to the base section. Each of the rails has a skirt depending from each of the sidewalls. The skirts are parallel to each other and to the sidewalls, but spaced more closely to each other than the spacing between the sidewalls. The space between the skirts is open, resulting in an elongated slot extending along the length of the rail.

A panel locates between the rails. The panel has an upper edge that fits into the elongated slot of the upper rail and a lower edge that fits within the elongated slot of the lower rail. In the preferred embodiment, the panel comprises a plurality of separate side-by-side channel members. Each channel member has a flat central section and a pair of flat side sections that are parallel to but offset from the central section. The side sections are joined by transition sections, defining a hat channel configuration.

Preferably each bracket has two of the rail mounting plates. Each rail mounting plate has a hole that aligns with the hole in one of the sidewalls of the rails defining a mating aperture. One of the holes of each mating aperture is elongated to allow the rail to be mounted at angles other than 90 degrees relative to the post. Also, preferably, each bracket has a stiffening plate that extends from the post mounting plate and has a width substantially the same as the post mounting plate.

DETAILED DESCRIPTION OF THE INVENTION

Figure 1:
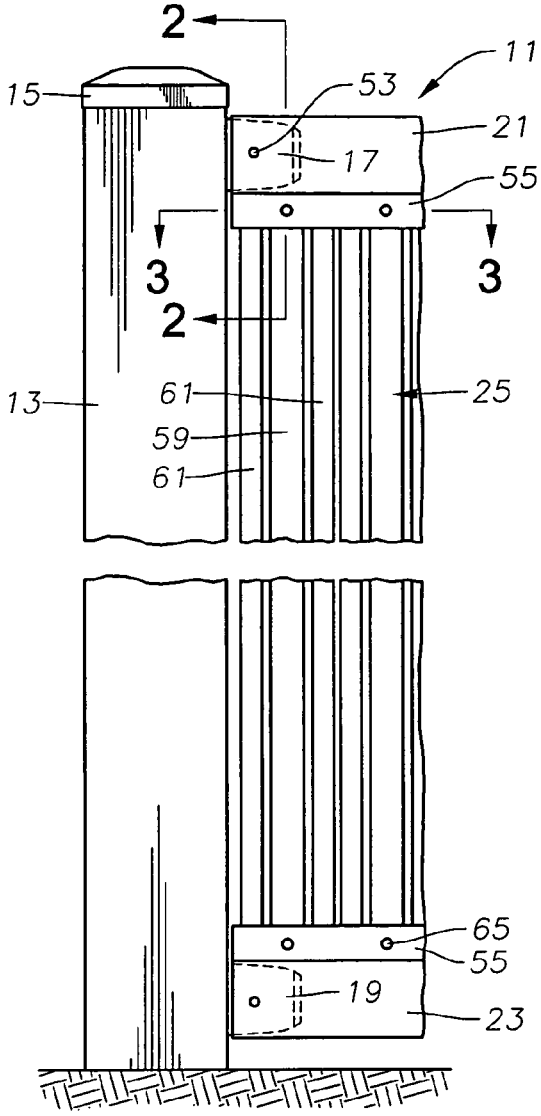
FIG. 1 is an elevational view of a portion of a fence constructed in accordance with this invention.

Referring to FIG. 1, fence 11 has a plurality of posts 13. Each post 13 is preferably square metal tubing and has a cap 15 that fits over the upper end of post 13. Post 13 is embedded in ground and preferably anchored by cement.

As shown by the dotted lines, upper and lower bracket 17, 19 are secured to post 13 along one side. An upper rail 21 attaches to upper bracket 17, and a lower rail 23 attaches to lower bracket 19. Upper and lower rails 21, 23 thus connect post 13 to the next post. A panel is supported by the upper and lower rails 21, 23 between posts 13. In the preferred embodiment, the panel comprises the plurality of panel members 25, each having side edges in substantial abutment to provide privacy.

Figure 2:
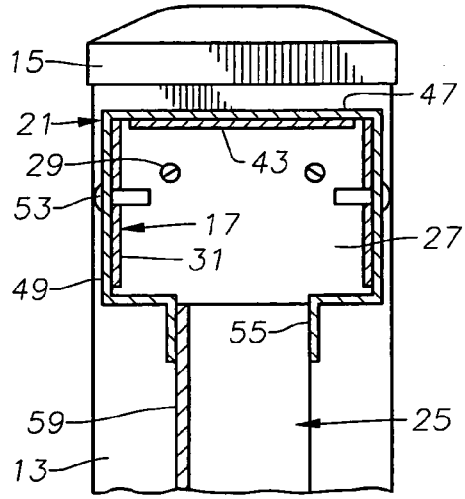
FIG. 2 is an enlarged sectional view of a portion of the fence of FIG. 1, taken along the line FIGS. 2—2 of FIG. 1.
Figure 4:
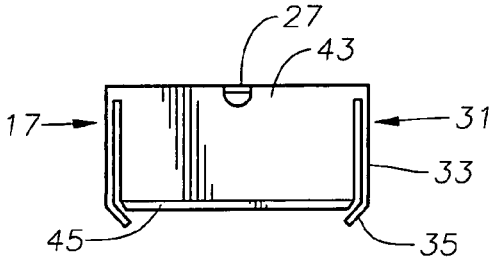
FIG. 4 is an enlarged top view of the upper bracket of the fence of FIG. 1.
Figure 7:
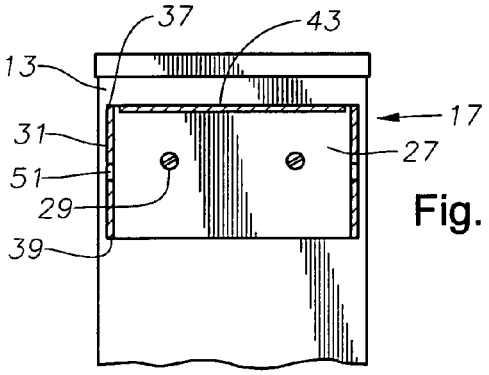
FIG. 7 is a sectional view of the bracket of FIG. 4, taken along the line 7—7 of FIG. 5.

Upper and lower brackets 17, 19 are preferably identical, but one is inverted relative to the other. All discussions concerning upper bracket 17 are applicable to lower bracket 19 as well. Referring to FIG. 4, upper bracket 17 has a post mounting plate 27 that is secured flat against a side of post 13 by fasteners 29, shown in FIGS. 2 and 7. Upper bracket 17 has a pair of rail mounting plates 31, each extending forward from a side edge of post mounting plate 27. Each rail mounting plate 31 has an orthogonal section 33 that joins post mounting plate 27 and extends forward in a plane perpendicular to the plane containing post mounting plate 27. A forward section 35 is located at the forward end of each orthogonal section 33. Forward section 35 is preferably in a plane that is angled relative to orthogonal section 33. A fold line exists at the junction of orthogonal section 33 with forward section 35, causing forward sections 35 to bend inwardly toward each other, as shown in FIG. 4. The width between forward edges of forward sections 35 is less than the width between the rearward edges of orthogonal sections 33.

Figure 5:
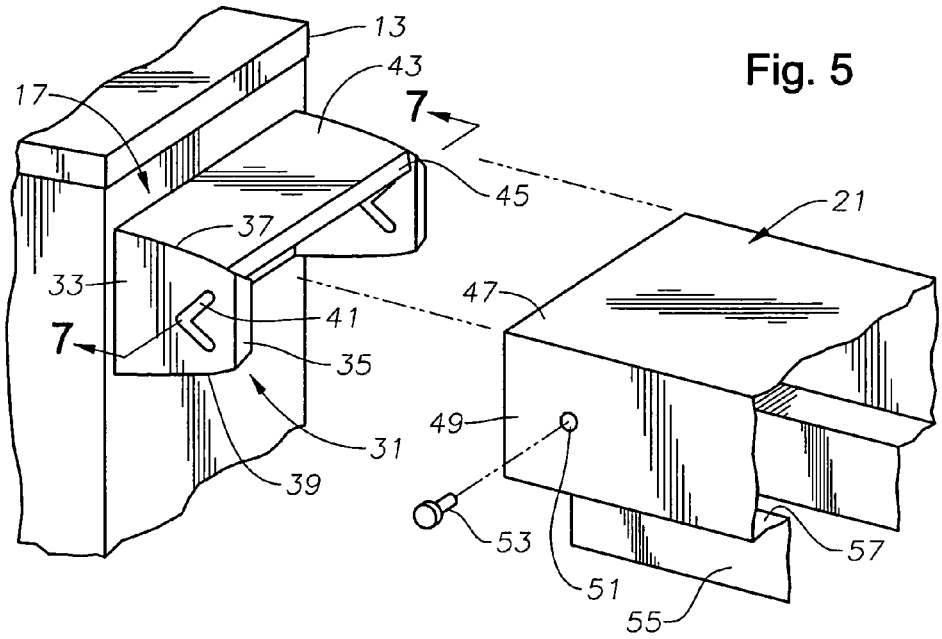
FIG. 5 is a perspective view of the upper bracket of FIG. 4, shown attached to a portion of the fence of FIG. 1, and showing a portion of a rail in exploded form.

Referring to FIG. 5, upper and lower edges 37, 39 of each rail mounting plate 31 preferably curve toward each other from the rearward to the forward direction. Upper and lower edges 37, 39 join a straight forward edge on forward section 35. A hole 41 is located in each orthogonal section 33.

In the preferred embodiment, as shown in FIGS. 4 and 5, upper bracket 17 has a stiffening plate 43 that extends forward from post mounting plate 27. Stiffening plate 43 has a width that is substantially the same as the width between orthogonal sections 33. Stiffening plate 43 is preferably curved downward at the same contour as upper edge 37. Stiffening plate 43 has a forward section 45 that is curved downward at a greater angle than stiffening plate 43. Stiffening plate forward section 45 of upper bracket 17 tilts downward, while the stiffening plate forward section 45 of lower bracket 19 (FIG. 1) tilts upward. Forward section 45 preferably locates between forward sections 35 of rail mounting plates 31. Rail mounting plates 31 preferably extend farther forward from post mounting plate 27 than stiffening plate 43.

Each bracket 17, 19 is preferably formed from a single sheet metal plate that is bent into the configuration shown. The flat plate is bent along vertical fold lines to form a corner between post mounting plate 27 and each of the two rail mounting plates 31. A horizontal fold line is made in the flat plate to form a corner between post mounting plate 27 and stiffening plate 43. The side edges of stiffening plate 43 are closely spaced and may touch inside surfaces of rail mounting plates 31. Each bracket 17, 19 has an overall channel shape having four sides, these being the post mounting plate 27, the two rail mounting plates 31, and the stiffening plate 43. The downward facing side of upper bracket 17 is open, while the upward facing side of lower bracket 19 is open.

The vertical height of each bracket 17, 19 decreases in a forward direction in forward sections 35 and 45 to facilate entry into an end of one of the rails 21, 23. Preferably, the post mounting plate 27 has a greater vertical dimension, measured from lower edge 39 (FIG. 7) than rail mounting plate forward sections 35.

Rails 21, 23 are also preferably fabricated sheet metal members with identical construction, but are inverted relative to one another. Referring still to FIG. 5, upper rail 21 has a base section 47 that is generally horizontal when installed. A sidewall 49 extends from each side edge of base section 47 in a vertical plane. The width between sidewalls 49 is approximately same as the width of post 13 and slightly greater than the width of bracket 17. The height of each sidewall 49 is slightly greater than the vertical height of each rail mounting plate 31. When the end of upper rail 21 slides over upper bracket 17, each rail mounting plate 31 will be located in flush contact with the interior side of each rail sidewall 49. A hole 51 is formed in each sidewall 49 for alignment with hole 41. Once in alignment, a fastener 53 inserts through holes 51 and 41 to secure rail 21. A nut may be employed on the inner side of each fastener 53.

Figure 6:
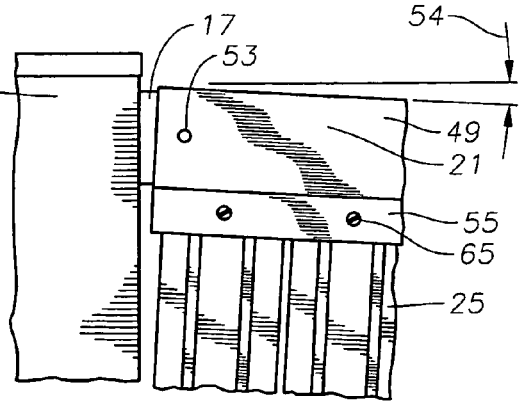
FIG. 6 is partial view of the fence of FIG. 1, illustrating the upper rail at an angle other than 90 degrees relative to the post.

One of the holes 41 or 51 is elongated and configured to allow angular adjustment of upper rail 21 relative to post 13. In this embodiment, hole 41 is elongated and is in the general shape of an L. As illustrated in FIG. 6, elongated hole 51 allows upper rail to be mounted to upper bracket 17 at an angle 54 relative to a line that is perpendicular to post 13. Since post 13 is normally vertical, angle 54 is a measurement of inclination relative to horizontal. Angle 54 may be negative as shown in FIG. 6 or positive, in which case it would be above the horizontal line. This adjustment is particularly useful for installing fence 11 in hilly terrain.

Referring again to FIG. 5, rail 21 has a skirt 55 depending downward. Skirt 55 joins sidewall 49 by a horizontal ledge 57. Skirts 55 are parallel to sidewalls 49, but spaced more closely to each other than the spacing between sidewalls 49. The lower side of rail 21 is open, defining an elongated slot between skirts 55.

Figure 3:
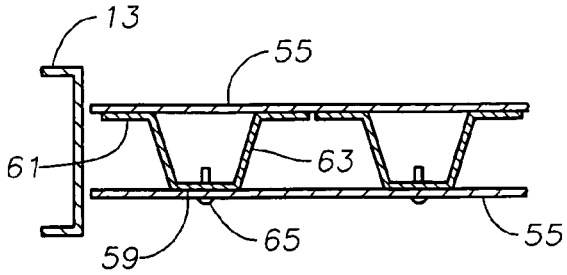
FIG. 3 is a sectional view of a portion of the fence of FIG. 1, taken along the line 3—3 of FIG. 1.

Referring to FIG. 3, preferably each panel member 25 is a section of sheet metal bent into the shape of a hat channel, but other shapes are feasible. Panel member 25 has a central section 59 that is flat and two side sections 61 on opposite sides. Side sections 61 are parallel to central section 59 and joined to central section 59 by transition sections 63 that are inclined. The distance between side sections 61 of each panel member 25 is greater than the width of each central section 59.

The distance between skirts 55 of rails 21 or 23 is slightly greater than the dimension of each panel member 25 between central section 59 and side sections 61. The ends of panel members 25 fit closely within the elongated slots formed by skirts 55. When placed between skirts 55, the upper end of central section 59 will be in flat abutment with the interior side of one of the skirts 55 and side sections 61 will be in flat abutment with the interior side of the opposite skirt 55. A fastener 65 inserts through skirt 55 and into central section 59 to secure each panel member 25. If desired, fasteners could be inserted into side sections 61, as well, but that has not been found necessary.

Preferably, for privacy, the side edges of each panel member side section 61 are closely spaced or abutting the side edges of the adjacent panel member 25. In the example of FIG. 3, central sections 59 of all of the panel members 25 are located on one side of fence 11. However, they could alternate, with every other central section 59 facing in opposite directions, if desired.

In the preferred embodiment, posts 13, caps 15, brackets 17, 19, rails 21, 23 and panel members 25 are formed of aluminum. Also, preferably, the components are powder coated at a factory with a paint that is long lasting and attractive.

To construct fence 11, the workers will secure posts 13 into the ground and anchor them with concrete in a conventional manner. Workers attach brackets 17, 19 at desired points on one side of post 13. The workers then slide rails 21, 23 over brackets 17, 19, position rails 21, 23 at the desired inclinations relative to posts 13, and secure them with fasteners 53. The workers then slide panel members 25 into the elongated slots between skirts 55 of rails 21, 23 and secure fasteners 55 into upper and lower ends of panel members 25.

The invention has significant advantages. The fence is easy to assemble, is durable and long lasting. The fence provides privacy and an attractive appearance.

The following invention has been shown in only one of its forms, it should be apparent to those skilled in the art that it is not so limited but is susceptible to various changes without departing from the scope of the invention.

I claim:

1. A fence section, comprising:

a post;

upper and lower brackets, each of the brackets having a post mounting plate secured to one side of the post and at least one rail mounting plate extending forward from the post mounting plate;

upper and lower rails, each of the rails having a pair of sidewalls extending from a base section, the sidewalls being parallel to each other and perpendicular to the base section, each of the rails having a ledge extending inward from and transverse to each of the sidewalls and a skirt depending from each of the ledges in a direction away from the base section, the skirts being parallel to each other and to the sidewalls, but spaced more closely to each other than the sidewalls, defining an elongated slot extending along the length of each of the rails;

the upper rail having an end secured to the rail mounting plate of the upper bracket and the lower rail having an end secured to the rail mounting plate of the lower bracket, the upper and lower rails being inverted relative to each other, with their elongated slots facing each other;

a panel having an upper edge that fits within the slot of the upper rail and a lower edge that fits within the slot of the lower rail; wherein:

at least a portion of each of the rail mounting plates is parallel to the sidewalls and in flush contact with an interior surface of one of the sidewalls of each of the rails;

each of the rail mounting plates has a hole that aligns with a hole in said one of the sidewalls of each of the rails, defining a mating aperture for receiving a fastener; and one of the holes of each of the mating apertures is elongated and inclined relative to an axis of the post to enable the rails to be mounted to the post at angles other than 90 degrees.

2. The fence section according to claim 1, wherein the panel comprises a plurality of channel members.

3. The fence section according to claim 1, wherein the panel comprises:

a plurality of side-by-side channel members, each channel member having a flat central section, a pair of flat side sections that are parallel to, offset from, and located on opposite sides of the central section, and a pair of transition sections that join the side sections to the central section, the transition sections being flat and converging toward each other.

4. The fence section according to claim 3, further comprising a panel fastener extending through one of the skirts of one of the rails into each of the channel members.

5. The fence section according to claim 1, wherein:

each of the holes in the rail mounting plates is elongated and has an upward inclined portion and a downward inclined portion to enable the rails to be tilted up or tilted down when connected to the rail mounting plates.

6. The fence section according to claim 1, wherein:

each of the brackets has a tapered section spaced forward from the post mounting section, each of the brackets having a width and height measured at the post mounting section that is less than a width and height measured at a forward end of the tapered section.

7. A fence section, comprising:

a post;

upper and lower brackets, each of the brackets having a post mounting plate secured to one side of the post and a pair of rail mounting plates extending from opposite side edges of the post mounting plate;

upper and lower rails, each of the rails having a pair of sidewalls extending from a base section, the sidewalls being parallel to each other and perpendicular to the base section, each of the rails having a flange extending inward from each of the sidewalls and a skirt depending from each of the flanges in a direction away from the base section, the skirts being parallel to each other and to the sidewalls and perpendicular to the flanges and spaced more closely to each other than the sidewalls, defining an elongated slot extending along the length of each of the rails;

the upper rail having an end that slides over and receives the rail mounting plates of the upper bracket, and the lower rail having an end that slides over and receives the rail mounting plates of the lower mounting bracket, each of the sidewalls of the upper and lower rails being parallel to and in contact with at least a portion of one of the rail mounting plates;

each of the rail mounting plates having a hole that aligns with a hole in one of the sidewalls, defining a mating aperture for receiving a fastener to secure the rails to the brackets;

the upper and lower rails being inverted relative to each other, with their elongated slots facing each other;

a panel having an upper edge that fits in the slot of the upper rail and a lower edge that fits within the slot of the lower rail;

a panel fastener for each panel extending through one of the skirts of one of the rails into each of the panels; and wherein:

one of the holes of each of the mating apertures is elongated and inclined relative to an axis of the post to enable the rails to be mounted to the post at angles other than 90 degrees.

8. A fence section, comprising:

a post;

upper and lower brackets, each of the brackets having a post mounting plate secured to one side of the post and a pair of rail mounting plates extending from opposite side edges of the post mounting plate;

upper and lower rails, each of the rails having a pair of sidewalls extending from a base section, the sidewalls being parallel to each other and perpendicular to the base section, each of the rails having a flange extending inward from each of the sidewalls and a skirt depending from each of the flanges in a direction away from the base section, the skirts being parallel to each other and to the sidewalls and perpendicular to the flanges and spaced more closely to each other than the sidewalls, defining an elongated slot extending along the length of each of the rails;

the upper rail having an end that slides over and receives the rail mounting plates of the upper bracket, and the lower rail having an end that slides over and receives the rail mounting plates of the lower mounting bracket, each of the sidewalls of the upper and lower rails being parallel to and in contact with at least a portion of one of the rail mounting plates;

each of the rail mounting plates having a hole that aligns with a hole in one of the sidewalls, defining a mating aperture for receiving a fastener to secure the rails to the brackets;

the upper and lower rails being inverted relative to each other, with their elongated slots facing each other;

a panel having an upper edge that fits in the slot of the upper rail and a lower edge that fits within the slot of the lower rail;

a panel fastener for each panel extending through one of the skirts of one of the rails into each of the panels; and a stiffening plate on each of the brackets, the stiffening plate having a width substantially the same as a width of the post mounting plate and extending forward from the post mounting plate between the rail mounting plates, the stiffening plate and the rail mounting plates of each of the brackets combining to define a channel configuration, and the stiffening plate having side edges that are spaced from the rail mounting plates by clearances.

9. The fence section according to claim 8, wherein the panel comprises:

a plurality of side-by-side channel members, each channel member having a flat central section, a pair of flat side sections that are parallel to, offset from, and located on opposite sides of the central section, and a pair of transition sections that join the side sections to the central section, the transition sections being flat and converging toward each other; and wherein the panel fastener for each of the panels extends into the flat central section of each of the panels.

10. The fence section according to claim 8, wherein:

each of the rail mounting plates of each of the brackets has a tapered section spaced forwardly from the post mounting section, each of the brackets having a width and height measured at the post mounting section that is less than a width measured at a forward end of the tapered section.

11. A fence section, comprising:

a post;

upper and lower brackets, each of the brackets having a post mounting plate secured to one side of the post;

a pair of rail mounting plates extending forward from opposite side edges of the post mounting plate of each of the brackets, each of the rail mounting plates having a hole;

a stiffening plate extending forward from the post mounting plate of each of the brackets between the rail mounting plates, the stiffening plate having a width substantially the same as a distance between each of the rail mounting plates and having side edges that are spaced from the rail mounting plates by clearances, the rail mounting plates and the stiffening plate of each of the brackets defining a channel configuration;

upper and lower rails, each of the rails having a pair of sidewalls extending from a base section, the sidewalls being parallel to each other and perpendicular to the base section, the sidewalls of the upper and lower rails being spaced apart from each other slightly more than the distance between each of the rail mounting plates;

the upper rail having an end that slides over the stiffening plate and the rail mounting plates of the upper bracket, and the lower rail having an end that slides over the stiffening plate and the rail mounting plates of the lower mounting bracket;

each of the sidewalls of the rails having a hole that aligns with one of the holes in one of the mounting plates, defining a mating aperture for receiving a fastener to secure the rails to the brackets; and one of the holes of each mating aperture being elongated and inclined relative to an axis of the post to allow the rails to be mounted to the brackets at angles other than 90 degrees relative to the post.

12. The fence section according to claim 11, wherein the stiffening plate and the mounting plates of each of the brackets has a rearward section that joins the post mounting plate, and a forward section that is in a plane angled relative to the rearward section.

13. The fence section according to claim 11, wherein each of the mounting plates of each of the brackets has an orthogonal section that joins the post mounting plate orthogonally, and a forward section that is in a plane angled relative to the orthogonal section, and wherein a distance between forward edges of the forward sections is less than a distance between the orthogonal sections.

14. The fence section according to claim 11, wherein each of the mounting plates of each of the brackets has a lower edge and an upper edge, each of the mounting plates has a forward section that is angled inward, and wherein the upper and lower edges converge toward each other.

15. The fence section according to claim 14, wherein the forward section of each of the mounting plates of each of the brackets extends farther from the post mounting plate than the stiffening plate.

16. The fence section according to claim 11, wherein said one of the holes of each of the mating apertures that is elongated has a central point for connection of the rails to the brackets when at 90 degrees relative to the post, an upward extending inclined section extending from the central point for connection of the rails when tilted upward relative to the post, and a downward extending inclined section extending from the central point for connection of the rails when tilted downward relative to the post.

* * * * *